United States Patent [19]

Shimono

[11] Patent Number: 5,035,267

[45] Date of Patent: Jul. 30, 1991

[54] METHOD OF AND APPARATUS FOR MANUFACTURING A CONCEALED WOVEN SLIDE FASTENER STRINGER

[75] Inventor: Muchiji Shimono, Namerikawa, Japan

[73] Assignee: Yoshida Kogyo K. K., Tokyo, Japan

[21] Appl. No.: 506,258

[22] Filed: Apr. 9, 1990

[30] Foreign Application Priority Data

Apr. 11, 1989 [JP] Japan ..... 1-42146[U]
Apr. 25, 1989 [JP] Japan ..... 1-104881

[51] Int. Cl.[5] ..... D03D 49/50; D03D 41/00

[52] U.S. Cl. ..... 139/116.1; 139/118; 139/384 B; 24/392

[58] Field of Search ..... 139/384 B, 118, 11, 139/35, 116.1; 24/392, 393

[56] References Cited

U.S. PATENT DOCUMENTS

| | | | |
|---|---|---|---|
| 3,961,652 | 6/1976 | Hasuda et al. . | |
| 4,498,503 | 2/1985 | Ofusa . | |
| 4,561,474 | 12/1985 | Ofusa | 139/384 B |
| 4,597,418 | 7/1986 | Ofusa | 139/384 B |
| 4,678,013 | 7/1987 | Ofusa et al. | 139/384 B |
| 4,682,635 | 7/1987 | Ofusa et al. . | |
| 4,799,515 | 1/1989 | Ohfusa | 139/384 B |
| 4,915,140 | 4/1990 | Ofusa et al. | 139/384 B |

FOREIGN PATENT DOCUMENTS

| | | |
|---|---|---|
| 0124129 | 11/1984 | European Pat. Off. . |
| 0275539 | 7/1988 | European Pat. Off. . |
| 1216594 | 8/1969 | Fed. Rep. of Germany . |
| 2051416 | 4/1971 | Fed. Rep. of Germany . |
| 46-7018 | 2/1971 | Japan . |
| 59-51815 | 12/1984 | Japan . |
| 63-37642 | 7/1988 | Japan . |
| 2034767 | 6/1980 | United Kingdom . |

*Primary Examiner*—Andrew M. Falik
*Attorney, Agent, or Firm*—Hill, Van Santen, Steadman & Simpson

[57] ABSTRACT

A method of and an apparatus for manufacturing a woven stringer for a concealed type of slide fastener having a row of continuous filamentary coupling elements woven integrally into a stringer tape. The row of coupling elements are formed into a continuous helical coil structure which is woven into a longitudinal edge of the stringer tape as the latter is woven and which is oriented so that each of the coupling elements has its heel portion disposed to project transversely beyond the longitudinal edge of the stringer tape and its coupling head portion directed toward a web portion of the tape when the stringer is produced. The resulting stringer when in use is folded back on a longitudinal axis so that the coupling head projects beyond the tape edge but is concealed from view when a pair of such stringers are coupled together.

16 Claims, 6 Drawing Sheets

METHOD OF AND APPARATUS FOR MANUFACTURING A CONCEALED WOVEN SLIDE FASTENER STRINGER

BACKGROUND OF THE INVENTION

1. Field of the Invention

The present invention relates to a method of and an apparatus for manufacturing a woven slide fastener stringer having a row of continuous filamentary coupling elements woven integrally into a stringer tape, and an article produced by such method and apparatus. More particularly, the invention is directed to the provision of a woven slide fastener stringer having such a row of coupling elements which are disposed so as to be concealed or masked from external view when the slide fastener is closed.

2. Prior Art

Various methods and apparatus for manufacturing woven slide fastener stringers have been proposed as disclosed for example in Japanese Patent Publication No. 59-51815 or Japanese Patent Publication No. 63-37642 wherein an element-forming filamentary material is woven into one longitudinal edge of a stringer tape simultaneously as the latter is woven. However, such prior art methods and apparatus are not capable of forming a woven slide fastener stringer of a concealed type with a row of coupling elements arranged to be concealed from view in a manner contemplated by the invention.

A concealed type of woven slide fastener is known typically from German Patent No. 1,216,594 wherein there is provided a stringer having a row of helically coiled coupling elements and a relatively thick longitudinal stiffening cord running between upper and lower leg portions of the elements, the leg portions being bound in place by warp and weft threads tensioned against the cord. This prior art stringer is literally thick or bulky along its longitudinal edge to which the coupling elements are secured and hence the coupling elements when woven present a relatively high profile leading to reduced flexibility.

Another concealed woven slide fastener is disclosed in Japanese Patent Publication No. 46-7018, which however has a drawback in that coupling elements in a continuous row are woven in the absence of linearly extending warp threads so that an element pitch or an element-to-element spacing becomes irregular or disarrayed, leading to inadvertant disengagement of the coupling elements on one stringer from those on the opposite mating stringer.

SUMMARY OF THE INVENTION

It is therefore an object of the present invention to provide a method of manufacturing a woven slide fastener stringer having a row of continuous filamentary coupling elements woven into a stringer tape along one longitudinal edge thereof in such a manner that the row of coupling elements when interengaged with a corresponding row of coupling elements on an opposite mating stringer is completely concealed from view and firmly secured in place against the influence of lateral pull or vertical thrust exerted to the stringer.

Another object of the invention is to provide an apparatus for reducing such method to practice, which is simple in construction and easy in maintenance.

A further object of the invention is to provide a woven slide fastener stringer for a concealed type slide fastener produced by the apparatus, which stringer has a row of continuous filamentary coupling elements woven to a relatively low profile.

According to the invention, there is provided a method of manufacturing a woven slide fastener stringer, comprising (a) weaving a stringer tape with a group of foundation warp threads, a group of fixing warp threads and a single weft thread progressively at a fell, said foundation warp threads and said weft thread jointly constituting a web portion of said tape and said fixing warp threads extending along one longitudinal edge of said tape, (b) forming upper and lower sheds between said groups of warp threads, (c) inserting said weft thread in double picks in said upper shed and introducing an element-forming filamentary material in said lower shed along a path extending substantially parallel to said warp threads, and (d) coiling said element-forming filamentary material into a row of coupling elements each having a coupling head portion, substantially superimposed upper and lower leg portions and a heel portion as said filamentary material is woven into said stringer tape along said one longitudinal edge thereof in synchronism with the weaving of said stringer tape; said coiling step including hooking said element-forming filamentary material with said heel portion oriented to project transversely beyond said one longitudinal edge of said stringer tape and with said head portion directed toward said web portion of said stringer tape.

DETAILED DESCRIPTION OF THE INVENTION

Figure 1:
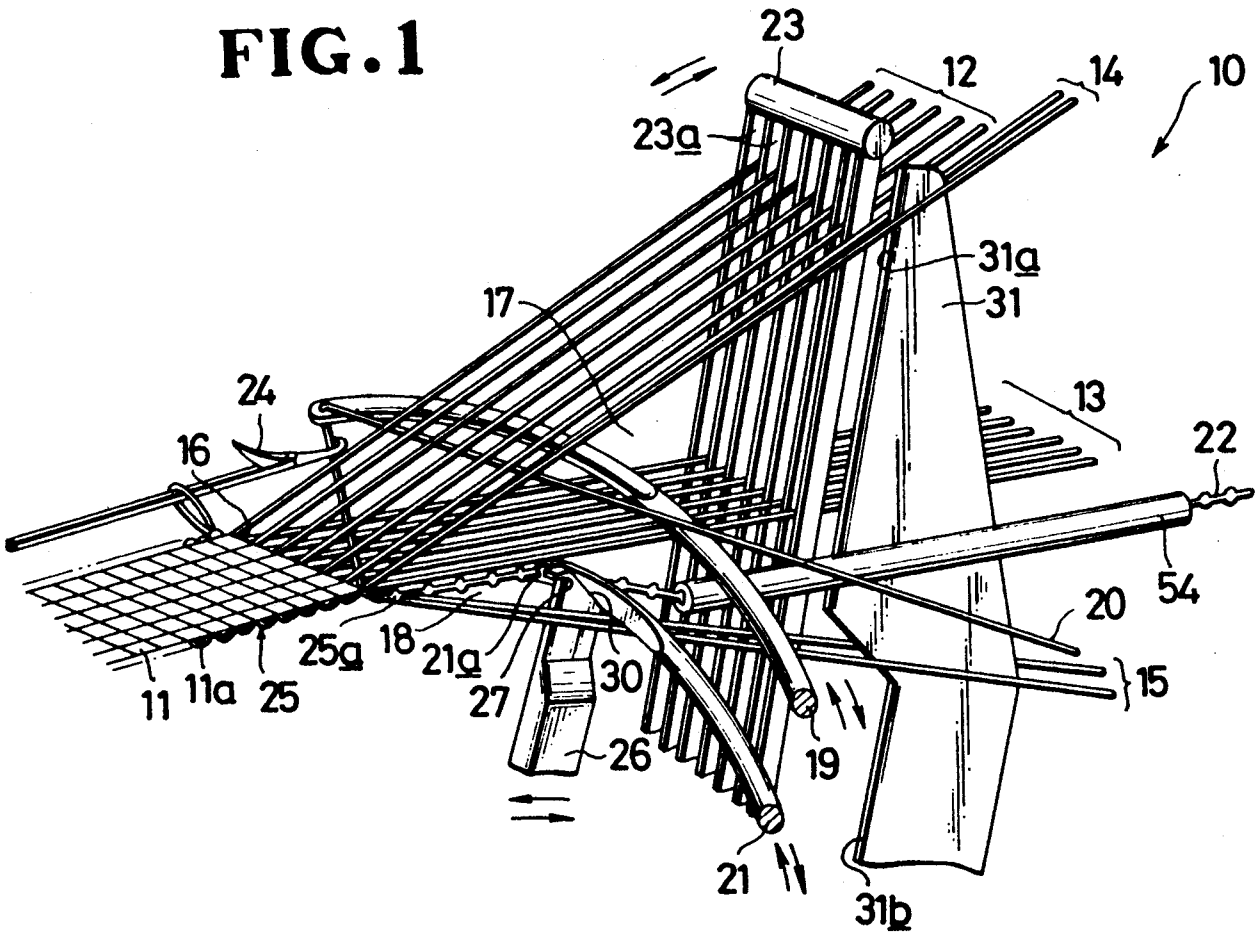
FIGS. 1 and 2 are schematic perspective views of an apparatus according to the present invention, the views showing parts in different positions while the apparatus is in operation to produce a woven slide fastener stringer.
Figure 2:
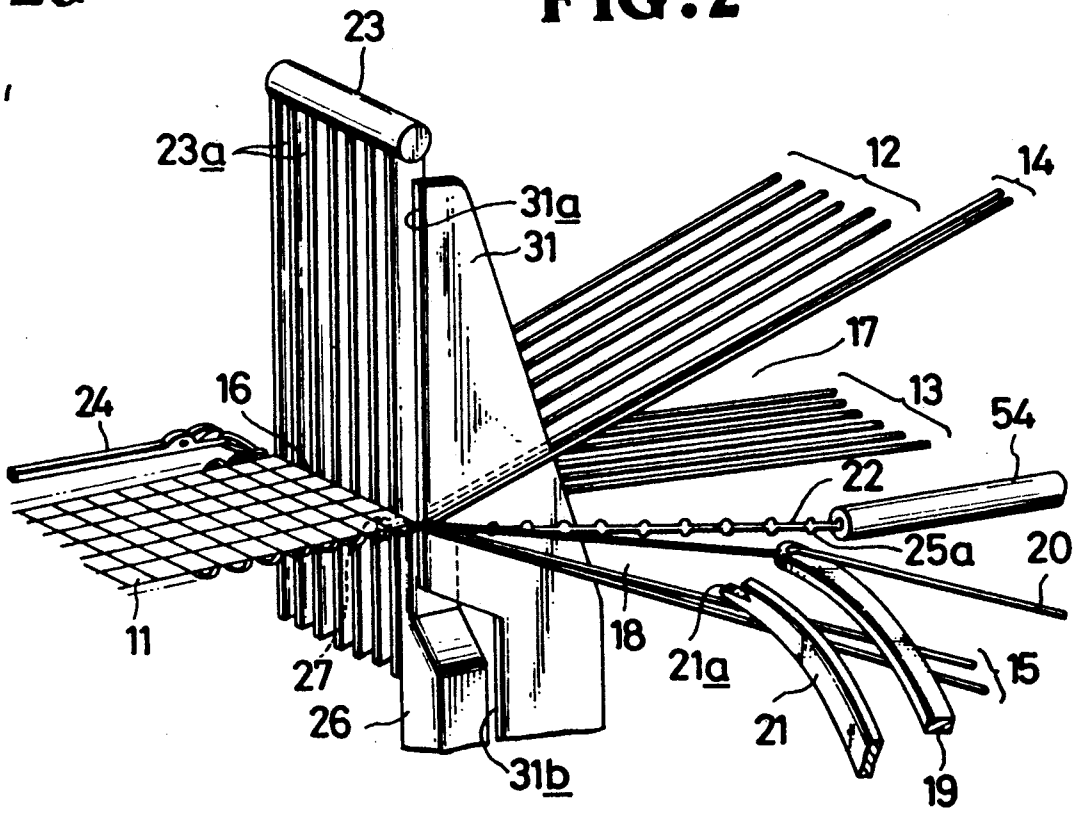

FIGS. 1 and 2 illustrate an apparatus for manufacturing a woven slide fastener stringer in accordance with the present invention. The apparatus comprises a loom 10 for progressively weaving a stringer tape 11 of warp threads 12, 13, 14, 15 at a fell 16, the loom 10 including conventional heddles or a shodding means not shown for forming a pair of upper and lower warp sheds 17, 18 between the warp threads 12, 13, 14, 15 and for selectively moving the warp threads 12–15 up and down, a first filling carrier or weft inserter 19 disposed at one longitudinal edge of the warp threads 12–15 and reciprocally movable across the upper shed 17 for inserting a weft thread 20 in double picks in the upper warp shed 17 between the warp threads 12–15 and a second filling carrier 21 disposed in parallel spaced relation to the first carrier 19 and reciprocally movable for inserting an element-forming filamentary material of synthetic resin 22 in the lower shed 18 between the warp threads 14, 15 woven along one longitudinal edge 11*a* of the stringer tape 11. The apparatus includes a reed 23 movable back and forth for beating the weft thread 20 inserted in the shed 17 against the fell 16, and a knitting needle 24 reciprocably disposed at the opposite edge of the warp threads 12–15 for successively knitting loops of the weft thread 20 projecting out the warp shed 17 to form a tape selvage. The reed 23 has a plurality of longitudinal guide slots 23*a* through which the warp threads 12, 13 extend to the fell 16.

The element-forming filamentary material of synthetic resin 22, which has a plurality of prospective coupling head portions 25*a* (FIGS. 1 and 2) formed in advance thereon at equal intervals, is introduced in the lower warp shed 18 to the fell 16 through a feed tube 54 extending substantially parallel to the warp threads 12–15.

The apparatus also includes a coiling means operable in synchronism with the loom 10 for coiling the element-forming filamentary material 22 into a row of coupling elements 25 whereby the row of coupling elements 25 is woven integrally into the stringer tape 11 as the latter is woven. The coiling means comprises a rocker arm 26 disposed at the one edge of the warp threads 12–15 and rockingly movable about one of its ends. As better shown in FIG. 3, the rocker arm 26 has at the opposite or distal end a hook 27 including a head portion 27*a* and a nose portion 27*b* extending therefrom in a direction parallel to the warp threads 12–15. The nose portion 27*b* has a transverse cross section which defines a space between a pair of upper and lower legs 28, 29 of each coupling element 25. The rocker arm 26 has a slanted surface 30 contiguous to the head portion 27*a* to enable the filamentary material 22 to slide smoothly thereon and over the nose portion 27*b* when the filamentary material 22 is brought by the second carrier 21 into hooked engagement with the hook 27 in a manner hereafter to be described. Upon rocking movement of the rocker arm 26, the hook 27 moves, in a plane substantially perpendicular to the general plane of the stringer tape 11, between a first position shown in FIGS. 2 and 3 in which it is located in alignment with the fell 16 and a second position shown in FIG. 1 in which it is located remotely from the fell 16.

Figure 3:
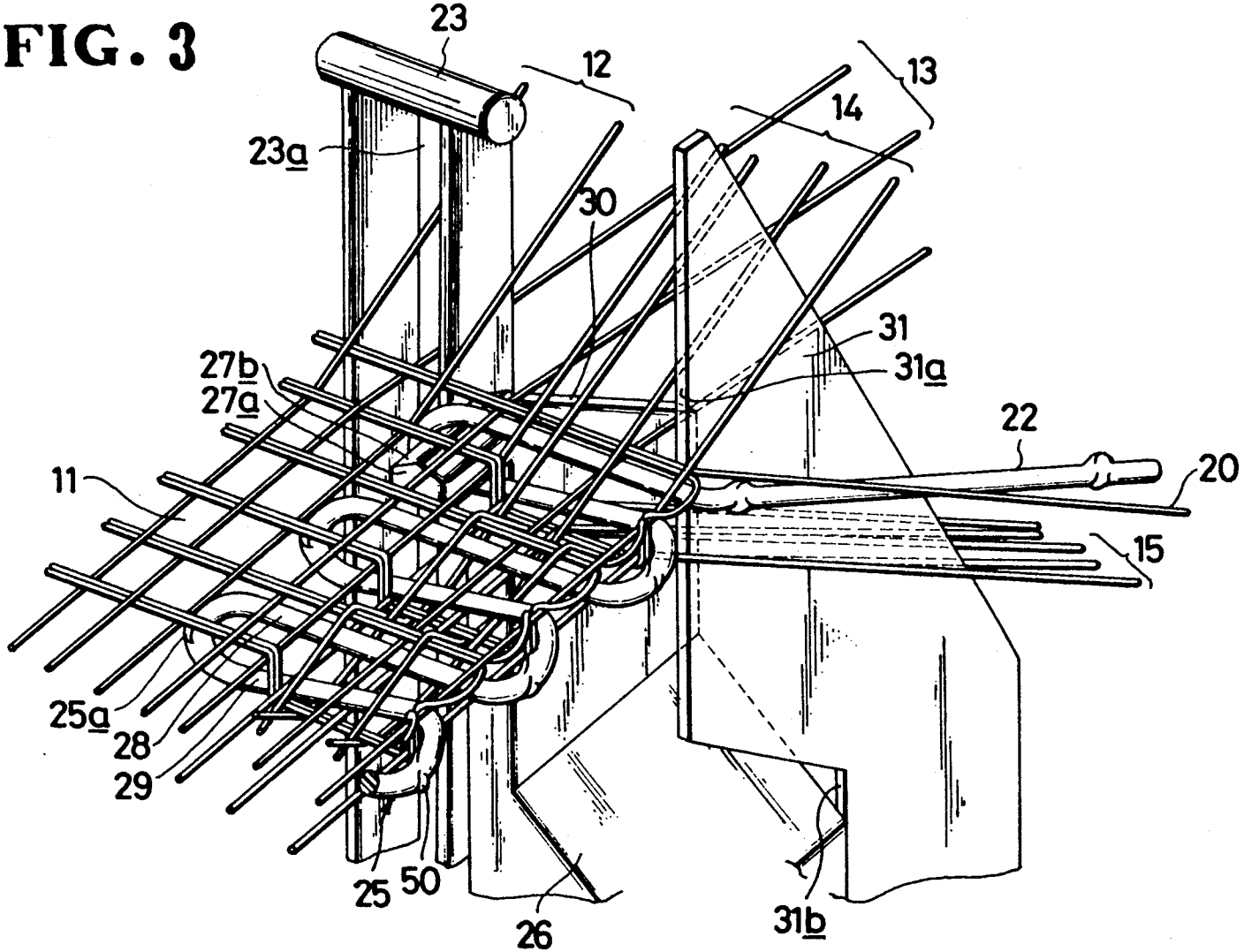
FIG. 3 is an enlarged perspective view of a portion of the apparatus shown in FIG. 2.

The coiling means also includes an element-shaping plate 31 removably secured to and movable with the reed 23 toward and away from the fell 16. The element-shaping plate 31 has a straight longitudinal punch edge 31*a* extending in parallel alignment with the slots 23*a* of the reed 23 and in between the group of warp threads 14 and 15 and adapted to beat the filamentary material 22 against the fell 16, as shown in FIGS. 2 and 3 and recessed as at 31*b* to preclude the danger of interference with the rocker arm 26. The element-shaping plate 31 may be adjusted, by suitable means such as bolts and nuts, in position relative to the reed 23, or may be replaced as and when it becomes worn on repeated frictional contact with the resinous filamentary material 22.

Figure 4:
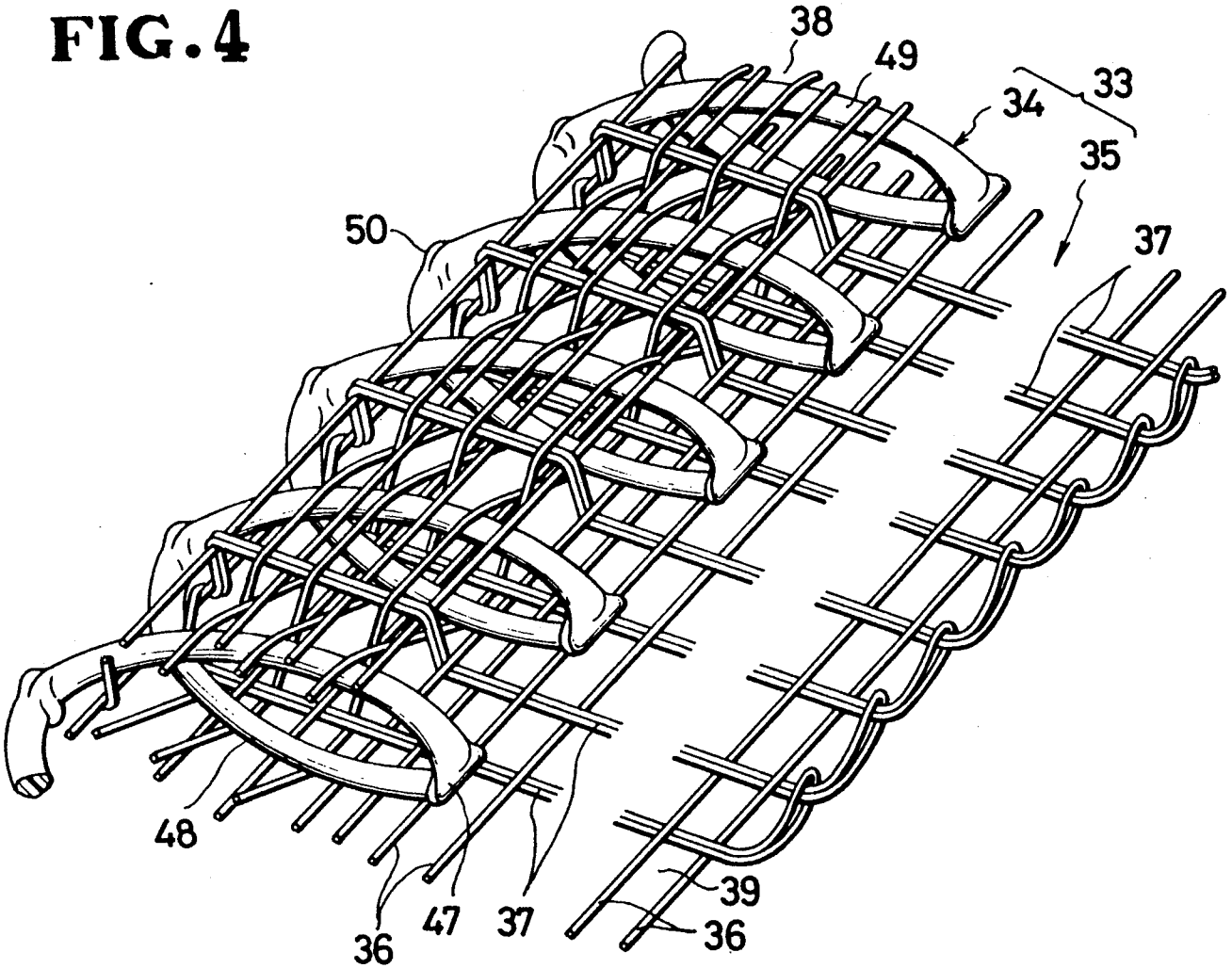
FIG. 4 is an enlarged perspective view of a portion of an exemplary slide fastener stringer produced by the apparatus of FIG. 1.
Figure 5:
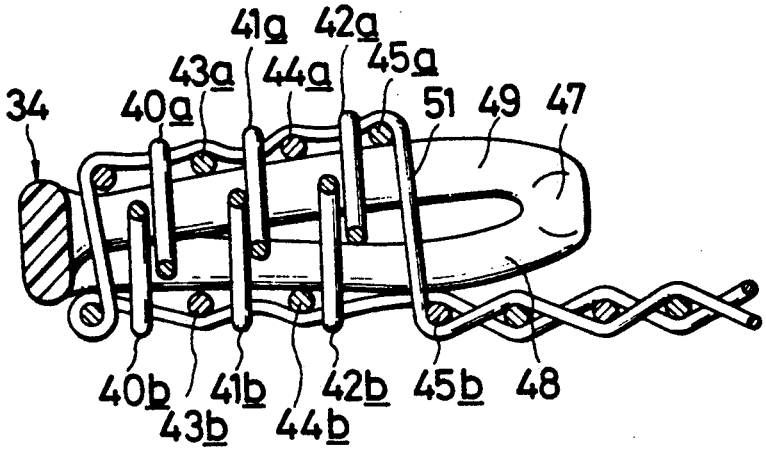
FIG. 5 is a diagrammatic transverse cross-sectional view of the stringer of FIG. 4.

The second carrier 21 has a bifurcated end portion 21*a* for receiving therein the element-forming filamentary material 22 having the equidistantly spaced prospective coupling head portions 25*a* (better shown in FIGS. 4 and 5). The second carrier 21 is actuated in timed relation to the rocker arm 26 so that while the hook 27 is at its second position shown in FIG. 1, the bifurcated end portion 21*a* of the carrier 21 engages the element-forming filamentary material 22 and carrier the same over the slanted surface 30 and the hook's head portion 27*a* into engagement with the nose portion 27*b*.

The apparatus thus constructed operates with a cycle of operation which for purpose of illustration begins under the conditions shown in FIG. 1 in which the element-forming filamentary material 22 is displaced by the second carrier 21 beyond the warp threads 14, 15 into hooked engagement with the hook 27; the weft thread 20 inserted or laid in by the first carrier 19 through the upper warp shed 17 is ready for hooked engagement with the knitting needle 24; and the reed 23 is retracted in a position away from the fell 16 of the stringer tape 11 being woven. Then, the rocker arm 26 is actuated to move angularly toward the fell 16 whereupon the hook 27 moves from the second position of FIG. 1 to the first position of FIGS. 2 and 3. At the same time, the reed 23 is actuated to move forward to beat the weft thread 20 just inserted against the fell 16 and the element-shaping plate 31 likewise moves forward in between the warp threads 14, 15 to beat the filamentary material 22 against the fell 16 along the longitudinal edge 11*a* of the tape 11. During that time, the element-forming filamentary material 22 is coiled around the hook's nose portion 27*b* substantially in parallel relation to the fell 16 to thereby form a coupling element 25.

Thereafter, while the rocker arm 26 and hence the hook 27 is at rest at the first position shown in FIGS. 2 and 3, the reed 23 is retracted together with the element-shaping plate 31 away from the fell 16, then the heddle not shown is actuated to move the warp threads 12–15 up and down across the warp sheds 17, 18, and the first carrier 19 is again actuated to insert the weft thread 20 in the upper warp shed 17. After the reed 23 has beat the weft thread 20 just inserted against the fell 16, the rocker arm 26 moves angularly away from the fell 16 to bring the hook 27 into the second position shown in FIG. 1. Simultaneously therewith, the reed 23 and the plate 31 are moved back again to their retracted position. Finally, the heddle is actuated to change the respective positions of the warp threads 12–15 into those shown in FIG. 1, to thereby complete a cycle of operation of the apparatus.

FIGS. 4–7 show an example of woven slide fastener stringer 33 produced by the apparatus of the present invention. The slide fastener stringer 33 comprises a row of coiled coupling elements 34 formed of synthetic resin fixed to a slide fastener stringer tape 35 woven of foundation warp threads 36 and a single foundation weft thread 37, the row of coupling elements 34 extending along a longitudinal edge portion 38 of the stringer tape 35. The foundation warp threads 36 and the foundation weft thread 37 jointly constitute a web portion 39 of the stringer tape 35. The row of coupling elements 34 is secured to one longitudinal edge portion 38 of the stringer tape 35 by means of a fixing warp thread system including a plurality of clamping warp threads 40*a*, 41*a*, 42*a*, 40*b*, 41*b*, 42*b* and a plurality of upper and lower binding warp threads 43*a*, 44*a*, 45*a*, 43*b*, 44*b*, 45*b*.

Each of the coupling elements 34 comprises a coupling head 47 and a pair of upper and lower legs 48, 49 extending from the coupling head 47 in a common direction and spaced from each other vertically in a direction substantially perpendicular to the general plane of the stringer tape 35. The upper and lower legs 48, 49 are merged into and interconnected by a heel portion 50 located remotely from the coupling head 47.

According to an important aspect of the invention, the heel portion 50 is oriented to project transversely beyond the longitudinal edge portion 38 of the tape 35, while the coupling head 47 is directed toward the web portion 39 of the tape 35.

The upper and lower binding warp threads 43*a*–45*a* and 43*b*–45*b* extend substantially in a straight run over the upper and lower legs 48 and 49, respectively of the coupling elements 34 so as to provide enhanced positional stability of the elements 34 in the longitudinal direction of the stringer 33. The binding warp threads 43*a*–45*a* and 43*b*–45*b* intersect the weft thread 37 in between adjacent coupling elements 34 as shown in FIG. 4. The clamping warp threads 40*a*, 41*a*, 42*a*, 40*b*, 41*b*, 42*b* are adapted to bring both legs 48, 49 of the elements 34 closely together.

Figure 6:
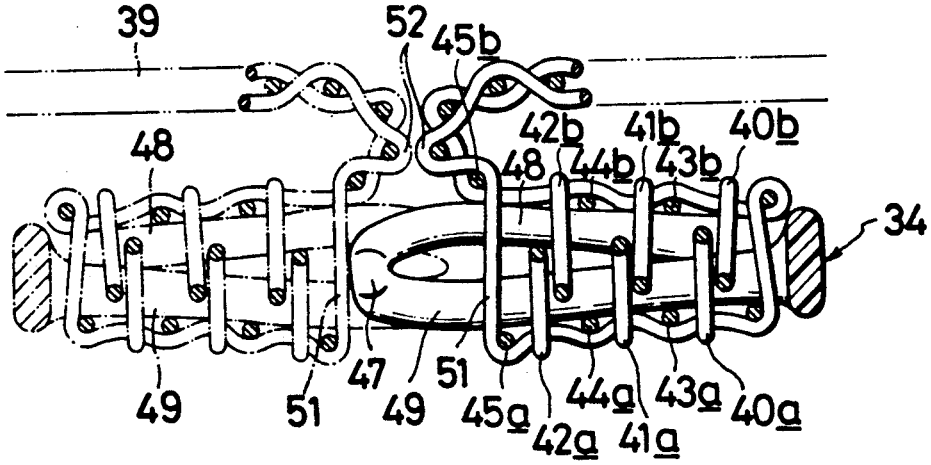
FIG. 6 is a diagrammatic transverse cross-sectional view of a pair of the stringers of FIG. 5 shown coupled together.
Figure 7:
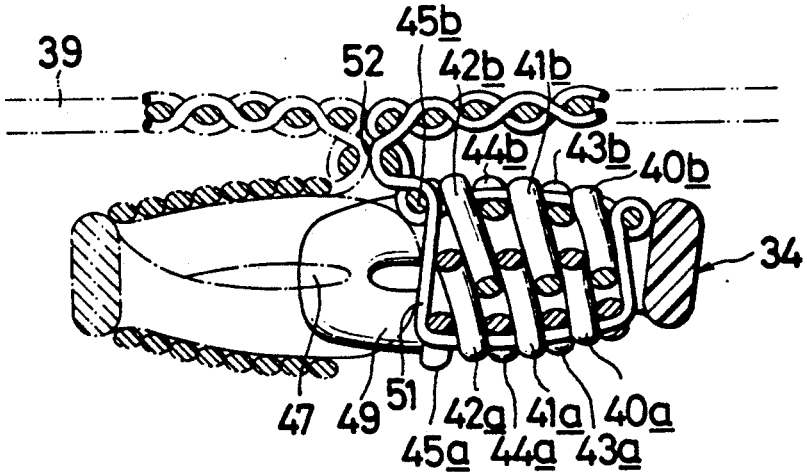
FIG. 7 is a view similar to FIG. 6 but depicting the stringers more realistically.

The foundation weft thread 37 passes around the last upper warp binding thread 45*a* up toward and around the last lower warp binding thread 45*b* to form a straight run or span 51 therebetween adjacent the coupling head 47 of the element 34 which extends substantially perpendicularly with respect to the general plane of the stringer tape 35. The straight span 51 of the weft thread 37 defines an axis about which the stringer tape 35 is folded back so that the coupling head portion 47 of each coupling element 34 now projects transversely beyond the longitudinal edge portion 38 of the tape 35, while the heel portion 50 of the element 34 is concealed from view by the web portion 39 of the tape 35 which has been turned over to overlie the heel portion 50 as shown in FIGS. 6 and 7. A portion of the weft thread 37 inserted in double picks, which is interlaced with the foundation warp threads 36 in the region of the straight span 51, forms an abutment 52 transversely projecting toward the coupling head 47 of the element 34. The abutment 52 on one of a pair of stringers 33 is brought into abutting engagement with that on the other of the paired stringers 33 when the two stringers 33 are coupled together in a well known manner by a slider not shown. The abutments 52 thus effectively conceal the row of coupling elements 34 from view and can remain joined together against lateral pull or vertical thrust by the fixing warp thread system described herein which holds the coupling elements 34 firmly in place with the upper and lower legs 48, 49 of the respective elements 34 substantially superimposed one upon another to lie substantially perpendicular to the general plane of the stringer 33 and flattened to assume a relatively low profile as shown in FIGS. 5–7.

Figure 8:
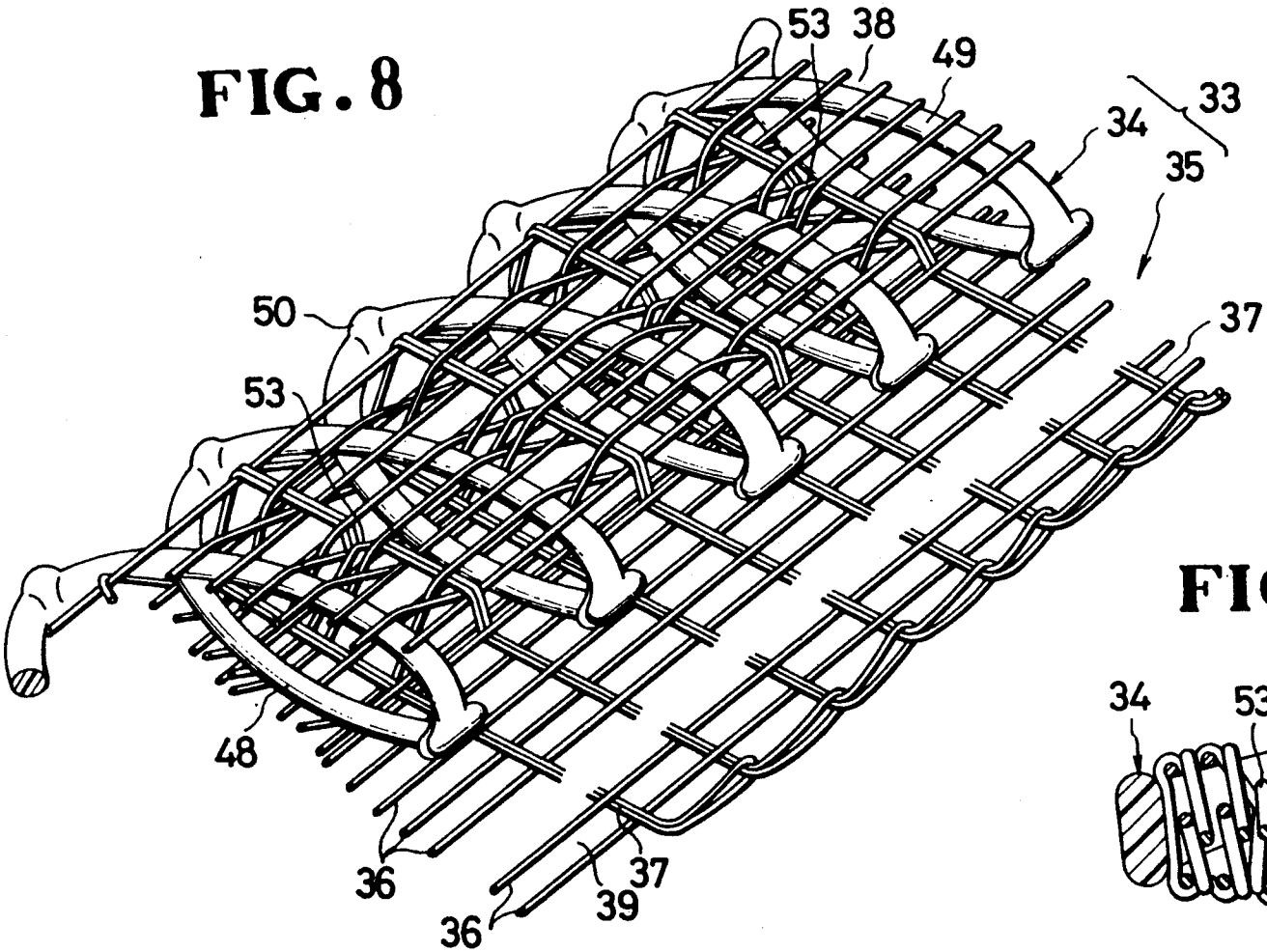
FIG. 8 is a view similar to FIG. 4 but showing a modified form of a woven stringer.
Figure 9:
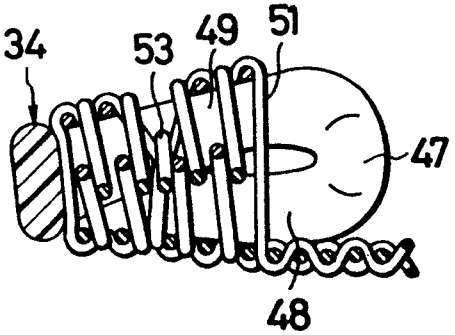
FIG. 9 is a diagrammatic transverse cross-sectional view of the stringer of FIG. 8.

FIGS. 8 and 9 show another embodiment of slide fastener stringer which is similar to the stringer 33 shown in FIGS. 4–7 except that there is provided a stiffening warp thread 53 which extends under and intermediate the group of lower binding warp threads 43*b*–45*b* to displace the weft thread 37 inwardly between adjacent coupling elements 34 to a level below the lower surface of the lower leg 49 of the elements 34, so as to bring the upper and lower legs 48, 49 more closely together, whereby the positional stability of the row of coupling elements 34 on the stringer 33 is further enhanced.

Obviously, various modifications and variations of the present invention are possible in the light of the above teaching. It is therefore to be understood that within the scope of the appended claims the invention may be practiced otherwise than as specifically described.

Figure 2A:
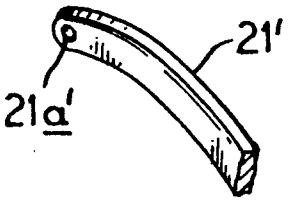
FIG. 2*a* is a partial schematic perspective view of an alternate embodiment of the second filling carrier.

For example, the second carrier 21 may be provided with an aperture in place of the bifurcated end portion 21*a* for receiving therethrough the filamentary material 22, as shown in FIG. 2*a*. In this alternate embodiment of the second carrier, an alternate second carrier 21' may be provided with an aperture or guidehole 21*a'* for receiving the filamentary material 22 therethrough.

What is claimed is:

1. A method of manufacturing a woven slide fastener stringer, comprising the steps of:

(a) weaving a stringer tape with a group of foundation warp threads, a group of fixing warp threads and a single weft thread progressively at a fell, said foundation warp threads and said weft thread jointly constituting a web portion of said tape and said fixing warp threads extending along one longitudinal edge of said tape;

(b) forming upper and lower sheds between said groups of warp threads;

(c) inserting said weft thread in said upper shed and introducing an element-forming filamentary material in said lower shed along a path extending substantially parallel to said warp threads; and (d) coiling said element-forming filamentary material into a row of coupling elements each having a coupling head portion, substantially superimposed upper and lower leg portions and a heel portion as said filamentary material is woven into said stringer tape along said one longitudinal edge thereof in synchronism with the weaving of said stringer tape; said coiling step including hooking said element-forming filamentary material with said heel portion oriented to project transversely beyond said one longitudinal edges of said stringer tape and with said head portion directed toward said web portion of said stringer tape.

2. An apparatus for manufacturing a woven slide fastener stringer, comprising:

(a) a loom for weaving a stringer tape of foundation warp threads, fixing warp threads and a single weft thread progressively at a fell, said foundation warp threads and said weft thread jointly constituting a web portion of said tape, and said fixing warp threads extending along one longitudinal edge of said tape, said loom including:

(1) a reed having guide slots for the passage therethrough of said foundation warp threads and adapted to beat said foundation weft threads against said fell, (2) an element-shaping plate secured to and movable with said reed toward and away from said fell, said element-shaping plate extending in parallel alignment with said guide slots and in between said fixing warp threads, (3) means forming upper and lower sheds for selectively moving said warp threads up and down, (4) a first filling carrier disposed at said one longitudinal edge of said stringer tape and reciprocable for introducing said weft thread in said upper shed into engagement with said warp threads, (5) a second filling carrier disposed in parallel spaced relation to said first filling carrier at said one longitudinal edge of said tape, and reciprocable for introducing an element-forming filamentary material in said lower shed, (b) a coiling means operable in synchronism with said loom for coiling said element-forming filamentary material into a row of coupling elements each having a coupling head portion, upper and lower leg portions and a heel portion, whereby the row of coupling elements are woven into said stringer tape as the latter is woven, said coiling means including a hook disposed at said one longitudinal edge of said stringer tape and movable in a plane perpendicular to the general plane of said stringer tape between a first position located in alignment with said fell and a second position remote from said fell, said hook during movement between said first and second positions causing each of said coupling elements to lie with said heel portion oriented to project transversely beyond said one longitudinal edge of said stringer tape and with said coupling head portion directed toward said web portion of said stringer tape.

3. An apparatus according to claim 2 wherein said element-shaping plate is removably secured to said reed.

4. An apparatus according to claim 2, wherein said first position is located between said reed and said element-shaping plate at said fell.

5. An apparatus according to claim 4, wherein said second filling carrier has a bifurcated distal end for receiving therein said element-forming filamentary material.

6. An apparatus according to claim 4, wherein said second filling carrier has an aperture in its distal end for receiving therethrough said element-forming filamentary material.

7. An apparatus according to claim 4, wherein said element-shaping plate has a straight punch edge extending in parallel alignment with said guide slots of said reed and adapted to beat said element-forming filamentary material against said fell.

8. An apparatus according to claim 2, wherein said second filling carrier has a bifurcated distal end for receiving therein said element-forming filamentary material.

9. An apparatus according to claim 2, wherein said second filling carrier has an aperture in its distal end for receiving therethrough said element-forming filamentary material.

10. An apparatus according to claim 2, wherein said element-shaping plate has a straight punch edge extending in parallel alignment with said guide slots of said reed and adapted to beat said element-forming filamentary material against said fell.

11. An apparatus for manufacturing a woven slide fastener stringer, comprising:

(a) a loom for weaving a stringer tape of foundation warp threads, fixing warp threads and a single weft thread progressively at a fell, said foundation warp threads and said weft thread jointly constituting a web portion of said tape, and said fixing warp threads extending along one longitudinal edge of said tape, said loom including:

(1) a reed having guide slots for the passage therethrough of said foundation warp threads and adapted to beat said foundation weft threads against said fell, (2) an element-shaping plate secured to and movable with said reed toward and away from said fell, said element-shaping plate extending in parallel alignment with said guide slots and in between said fixing warp threads, (3) means forming upper and lower sheds for selectively moving said warp threads up and down, (4) a first filling carrier disposed at said one longitudinal edge of said stringer tape and reciprocable for introducing said weft thread in said upper shed into engagement with said warp threads, (5) a second filling carrier disposed in parallel spaced relation to said first filling carrier and reciprocable for introducing an element-forming filamentary material in said lower shed, said second filler carrier having a bifurcated distal end for receiving therein said element-forming filamentary material, (b) a coiling means operable in synchronism with said loom for coiling said element-forming filamentary material into a row of coupling elements each having a coupling head portion, upper and lower leg portions and a heel portion, whereby the row of coupling elements are woven into said stringer tape as the latter is woven, said coiling means including a hook disposed at said one longitudinal edge of said stringer tape and movable in a plane perpendicular to the general plane of said stringer tape between a first position located in alignment with said fell and a second position remote from said fell, said hook during movement between said first and second positions causing each of said coupling elements to lie with said heel portion oriented to project transversely beyond said one longitudinal edge of said stringer tape and with said coupling head portion directed toward said web portion of said stringer tape.

12. An apparatus for manufacturing a woven slide fastener stringer, comprising:

(a) a loom for weaving a stringer tape of foundation warp threads, fixing warp threads and a single weft thread progressively at a fell, said foundation warp threads and said weft thread jointly constituting a web portion of said tape, and said fixing warp threads extending along one longitudinal edge of said tape, said loom including:

(1) a reed having guide slots for the passage therethrough of said foundation warp threads and adapted to beat said foundation weft threads against said fell, (2) an element-shaping plate secured to and movable with said reed toward and away from said fell, said element-shaping plate extending in parallel alignment with said guide slots and in between said fixing warp threads, (3) means forming upper and lower shed for selectively moving said warp threads up and down, (4) a first filling carrier disposed at said one longitudinal edge of said stringer tape and reciprocable for introducing said weft thread in said upper shed into engagement with said warp threads, (5) a second filling carrier disposed in parallel spaced relation to said first filling carrier and reciprocable for introducing an element-forming filamentary material in said lower shed, said second filling carrier having an aperture in its distal end for receiving therethrough said element-forming filamentary material, (b) a coiling means operable in synchronism with said loom for coiling said element-forming filamentary material into a row of coupling elements each having a coupling head portion, upper and lower leg portions and a heel portion, whereby the row of coupling elements are woven into said stringer tape as the latter is woven, said coiling means including a hook disposed at said one longitudinal edge of said stringer tape and movable in a plane perpendicular to the general plane of said stringer tape between a first position located in alignment with said fell and a second position remote from said fell, said hook during movement between said first and second positions causing each of said coupling elements to lie with said heel portion oriented to project transversely beyond said one longitudinal edge of said stringer tape and with said coupling head portion directed toward said web portion of said stringer tape.

13. An apparatus for manufacturing a woven slide fastener stringer, comprising:

(a) a loom for weaving a stringer tape of foundation warp threads, fixing warp threads and a single weft thread progressively at a fell, said foundation warp threads and said weft thread jointly constituting a web portion of said tape, and said fixing warp threads extending along one longitudinal edge of said tape, said loom including:

(1) a reed having guide slots for the passage therethrough of said foundation warp threads and adapted to beat said foundation weft threads against said fell, (2) an element-shaping plate secured to and movable with said reed toward and away from said fell, said element-shaping plate extending in parallel alignment with said guide slots and in between said fixing warp threads, said element-shaping plate having a straight punch edge extending in parallel alignment with said guide slots of said reed and adapted to beat said element-forming filamentary material against said fell, (3) means forming upper and lower sheds for selectively moving said warp threads up and down, (4) a first filling carrier disposed at said one longitudinal edge of said stringer tape and reciprocable for introducing said weft threads in said upper shed into engagement with said warp threads, (5) a second filling carrier disposed in parallel spaced relation to said first filling carrier and reciprocable for introducing an element-forming filamentary material in said lower shed, (b) a coiling means operable in synchronism with said loom for coiling said element-forming filamentary material into a row of coupling elements each having a coupling head portion, upper and lower leg portions and a heel portion, whereby the row of coupling elements are woven into said stringer tape as the latter is woven, said coiling means including a hook disposed at said one longitudinal edge of said stringer tape and movable in a plane perpendicular to the general plane of said stringer tape between a first position located in alignment with said fell and a second position remote from said fell, said hook during movement between said first and second positions causing each of said coupling elements to lie with said heel portion oriented to project transversely beyond said one longitudinal edge of said stringer tape and with said coupling head portion directed toward said web portion of said stringer tape.

14. A woven slide fastener stringer comprising:

(a) a woven stringer tape including a web portion woven of a plurality of foundation warp threads and a single foundation weft thread;

(b) a row of continuous filamentary coupling elements disposed on one longitudinal edge portion of said stringer tape and spaced longitudinally from each other, each of said coupling elements including a coupling head portion, a pair of upper and lower leg portions extending from said coupling head in a common direction and substantially perpendicular to the general plane of said stringer tape, and a heel portion located remotely from said coupling head portion and interconnecting one of said upper and lower leg portions to an adjacent coupling element, and (c) a fixing warp thread system securing said row of coupling elements in position against displacement and including a plurality of clamping warp threads and a plurality of upper and lower binding warp threads, said upper and lower binding warp threads extending substantially in a straight run over said upper and lower leg portions, respectively, of said coupling elements, and said clamping warp threads extending between adjacent said upper and lower binding threads into engagement with said weft thread; and said weft thread having a straight span formed adjacent said coupling head portion and extending substantially perpendicularly with respect to the general plane of said stringer tape and defining an axis about which said stringer tape is folded back with said coupling head portion of each coupling element projecting transversely beyond said one longitudinal edge of said stringer tape.

15. A woven slide fastener stringer according to claim 14 wherein said straight span forms an abutment on one of a pair of stringers in abutting engagement with a corresponding abutment on the other stringer.

16. A woven slide fastener stringer according to claim 14 wherein said fixing warp thread system further includes a stiffening warp thread extending under and intermediate said lower binding warp threads into engagement said weft thread.

* * * * *